United States Patent [19]

Mustoe

[11] 4,219,761

[45] Aug. 26, 1980

[54] INCANDESCENT LAMP DIMMER PROVIDING CONTROL VOLTAGE IES SQUARE LAW COMPLIANCE CORRECTION

[75] Inventor: Edward H. Mustoe, Austin, Tex.

[73] Assignee: Esquire, Inc., New York, N.Y.

[21] Appl. No.: 956,272

[22] Filed: Oct. 31, 1978

[51] Int. Cl.[2] ..... H05B 39/04

[52] U.S. Cl. ..... 315/307; 315/194; 315/291

[58] Field of Search ..... 315/194, 199, 291, 307, 315/DIG. 4

[56] References Cited

U.S. PATENT DOCUMENTS

| | | | |
|---|---|---|---|
| 3,419,753 | 12/1968 | Schultz et al. | 315/194 |
| 3,746,970 | 7/1973 | Van Cleave | 315/307 |
| 3,821,601 | 6/1974 | Kappenhagen et al. | 315/194 X |

FOREIGN PATENT DOCUMENTS

| | | | |
|---|---|---|---|
| 44-14861 | 7/1969 | Japan | 315/194 |

*Primary Examiner*—Eugene R. LaRoche
*Attorney, Agent, or Firm*—Frank S. Vaden, III

[57] ABSTRACT

A dimmer and regulation circuit connected to an incandescent lamp load for controlling the voltage thereto from an ac source by gating off a portion of each cycle. The circuit used to provide the gating includes a pulse generator controlled by a timer producing a rectangular wave output. The input to the timer is from an operational amplifier, the inputs to which are, in turn, from a variable control voltage setting and from a load sensing network including components for non-linear curve shaping processing, such as in accordance with the IES square law curve. These inputs operate in a closed loop feedback system to provide line and load regulation after the sensed load voltage passes through the square law shaping network. This non-linear network includes a half wave rectifier and a capacitor that is part of two time constant networks, and which accumulates a charge during one-half of a cycle through a first resistance path and which discharges through a second resistance path.

8 Claims, 3 Drawing Figures

INCANDESCENT LAMP DIMMER PROVIDING CONTROL VOLTAGE IES SQUARE LAW COMPLIANCE CORRECTION

BACKGROUND OF THE INVENTION

1. Field of the Invention

This invention pertains to lamp dimming circuits and more particularly to such circuits that provide regulation as well as dimming and provide IES square law compensation for incandescent lamps at various light intensity settings.

2. Description of the Prior Art

Complex control and regulation of incandescent lamps are desirable in many applications, but none may be more critical than the control and regulation of such lamps employed in stage lighting. It is quite common for there to be a plurality of lamps at different locations and a plurality of banks of lamps to achieve intricate gradations of light intensity for many special effects.

Light control systems in the past have recognized the desirability of utilizing a compensation network in accordance with the IES square law compliance curve. The reason for having such compensation is that the human eye does not respond linearly to changes in light intensity, but in accordance with a square wave response. Systems in the prior art have applied line voltages through networks to apply such correction. Such systems waste energy, however, by using components that are not useful in light production to absorb part of the applied energy. Also, the aging of components distorts the response. Furthermore, the range of operation where the lights are operated at their dimmest has been extremely difficult to regulate using prior art systems, since snap-on and snap-off of the lights occurs. That is, there is no gradual and controlled lighting from off to dim. Such light jumps are distracting to both audiences and performers alike and can destroy the careful mood settings that are so important.

Finally, separate line regulators are usually employed apart from load sensing regulators to compensate for possible variations in applied source voltages. That is, the prior art systems just discussed are not able to distinguish from an intentional decrease in applied voltage to a lamp load from an unintentional decrease because of an uncontrolled line voltage variation drop.

Therefore, it is a feature of the present invention to provide a common circuit that achieves improved line and load regulation in an incandescent lamp dimmer.

It is another feature of the present invention to provide an improved incandescent lamp dimmer wherein IES square law compliance correction is developed by sensing the voltage across the lamp, rather than just applying it in conjunction with the power applied to the lamp.

It is still another feature of the present invention to provide an improved line and load regulation in an incandescent lamp dimmer by using voltage sensing of the load voltage, applying such sensed voltage to an IES square law shaping network and using the voltage after such network for regulation purposes.

It is yet another feature of the present invention to provide an improved IES square law shaping network useful in a control path of an incandescent lamp dimmer and regulation circuit wherein the network charges and discharges at different times and at different rates to achieve non-linear correction.

It is still another feature of the present invention to provide an improved incandescent lamp dimmer employing an integrated circuit operational amplifier as a summing amplifier and employing a pulse generator controlled by a Model 555 timer.

SUMMARY OF THE INVENTION

The preferred embodiment of the present invention includes thyristors for applying source voltage to the lamp load, the gating of the thyristors determining the average voltage applied thereto. The gating of the thyristors is via a pulse generator, the duration of the pulses therefrom being determined by the output rectangular wave of a timer. The timer is controlled by the level of output voltage from an operational amplifier, the input to which is a critical summing point for a control voltage and a voltage derived from sensing the voltage across the lamp load.

The voltage derived from sensing the load voltage is developed in a curve sensing network comprising a diode for half-wave rectifying the sensed voltage, a first resistance-capacitor path for charging the capacitor during one-half of the sensed voltage cycles, and another resistance-capacitor path for discharging the capacitor into an operational amplifier inverter. Therefore, the processed voltage from the curve-shaping network is of opposite polarity from the control voltage and, at equilibrium of operation, is equal thereto. Such a curve-shaping network provides selection of components for achieving IES square law compliance curve operation.

A change in either the processed voltage (typically due to a line change) or of the control voltage changes the timing of the pulses to the thyristors, and hence the average voltage across the lamps, so that the total voltage at the summing point is again zero.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiment thereof which is illustrated in the drawings, which drawings form a part of this specification. It is to be noted, however, that the appended drawings illustrate only a typical embodiment of the invention and are therefore not to be considered limiting of its scope, for the invention may admit to other equally effective embodiments.

IN THE DRAWINGS

Figure 1:
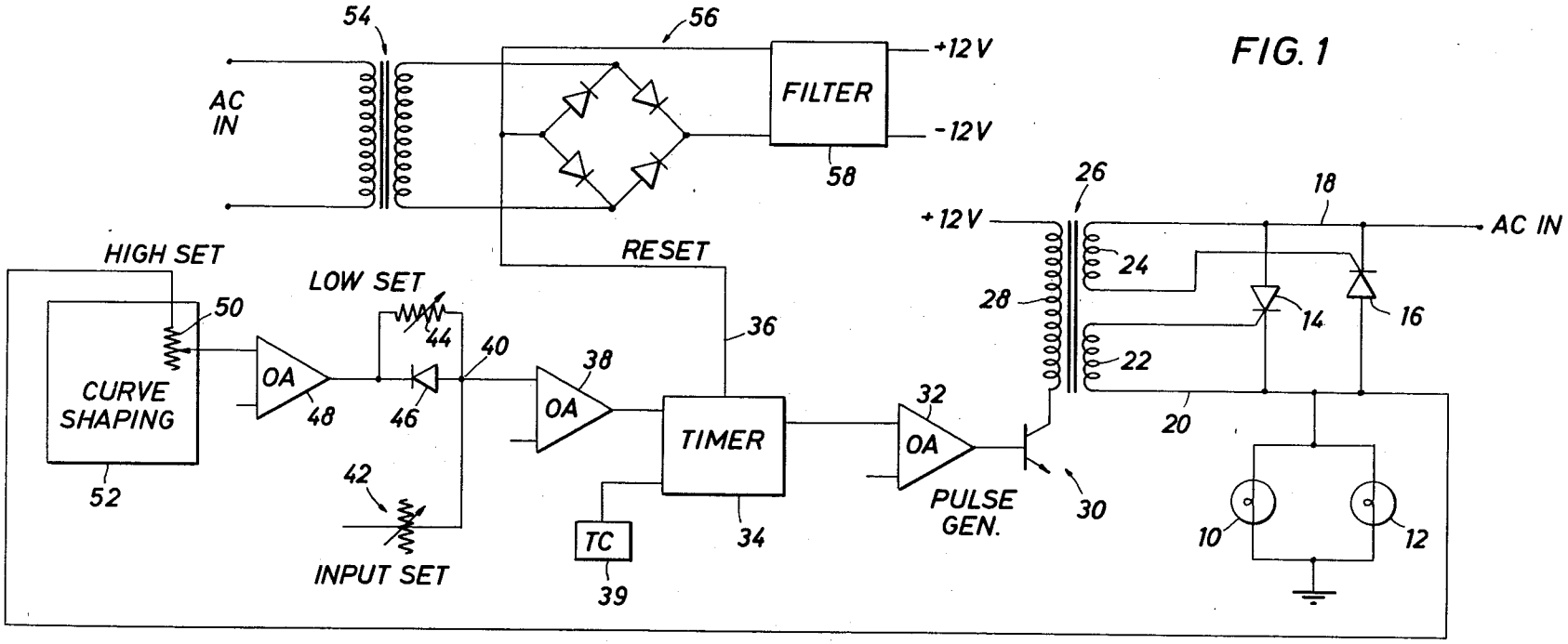

FIG. 1 is a simplified diagram of the preferred embodiment of the present invention.

Figure 2:
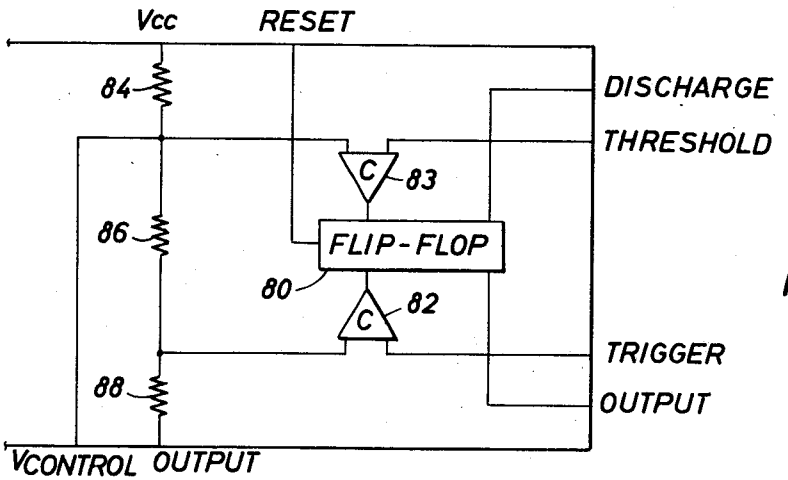

FIG. 2 is a simplified diagram of a timer network used in the embodiment of the invention shown in FIG. 1.

Figure 3:
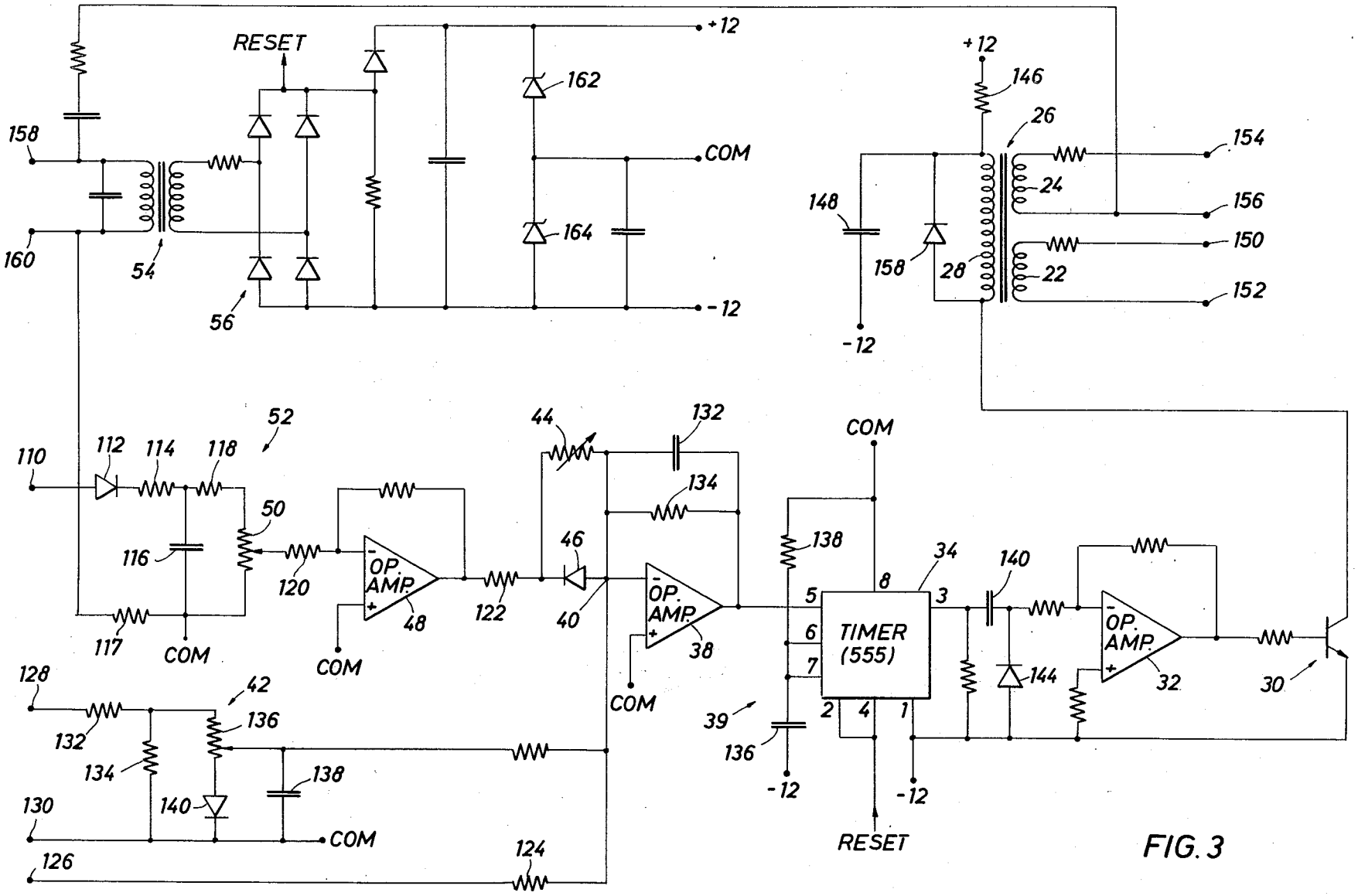

FIG. 3 is a schematic diagram of the preferred embodiment of the invention shown in FIG. 1.

DESCRIPTION OF THE PREFERRED EMBODIMENT

Now referring to the block diagram shown in FIG. 1, lamps 10 and 12, to be the subject of dimming and regulation action, are connected in parallel with each other. One end of the parallel connection is tied to circuit common or ground and the other end of the parallel connection is tied to one or more thyristors connected to supply line current to the lamps. In the present case, gated semiconductor devices in the form of back-to-back SCR's 14 and 16 are connected between high power line 18 and a so-called "load" line 20, connected to the opposite side of lamps 10 and 12 from the common connection.

It may be seen that when the SCR's are conducting for the full cycle of line current, then current is supplied to the lamps for maximum duration, thereby achieving full bright operation. When the SCR's are conductive for only a portion of the cycle of line current, then less than full cycle average current is supplied through the lamps, thereby achieving a dim operation. The portion of the line current cycle in which the SCR's are conductive determines how bright the lamp operation is. Therefore, the full range is between off operation (i.e., no conduction of the SCR's) to full bright (i.e., full-cycle conduction operation).

The gates of SCR's 14 and 16 are connected to separate secondary windings 22 and 24, respectively, of isolation transformer 26. The cathode of SCR 14 is connected to load line 20, its anode to high power line 18 and its gate to the center-most connection of winding 22. The cathode of SCR 16 is connected to high line 18, its anode to load line 20 and its gate to the center-most connection of winding 24. It should be noted that the gate connections of the SCR's with respect to windings 22 and 24 are such to achieve alternating conduction of the SCR's with the alternating cycles occurring in the voltage across windings 22 and 24.

Primary winding 28 of transformer 26 is connected to the collector of a semiconductor switch in the form of npn transistor 30. Base current is supplied transistor 30 by operational amplifier 32, which, in turn, receives its input from timer 34. The output from timer 34 is a rectangular wave occurring each half-cycle of the line current. The trailing edge of the rectangular wave is variable with respect to the leading edge depending on the input applied to the timer. There is a pulse output, however, from operational amplifier 32 at the occurrence of each trailing edge. Each time transistor 30 switches on, a current flows through the transformer and through the transistor until transistor 30 again switches off. Actually, as is explained hereinafter, there is a storage capacitor, not shown in FIG. 1, which aids in providing the gate pulses from transformer 26. The result is that there is a pulse produced from transistor 30 each half cycle of line current. If the pulse occurs early in the half cycle, then gate voltage is applied to the respective SCR early in the half cycle to cause conduction for nearly the full half cycle. As explained above, this is near "full bright" operation. If the pulse occurs near the end of the half cycle to cause conduction for only a small portion thereof, this is near "full dim" operation. Thus, pulsing on of the SCR's occurs alternately, each SCR being pulsed 60 times a second for normal 60 Hz line frequency. The SCR's are self-commutating when the line current therethrough reverses each half cycle. Therefore, once pulsed on, an SCR stays conductive through the remaining half cycle until the current therethrough reverses.

Timer 34 is reset each half cycle of the rectified line voltage via line 36. The input to timer 34 is from high gain amplifier 38, which applies a dc level dependent on the input conditions to amplifier 38. Another input to timer 34 is from time constant network 39, which is discharged by the reset signal to the timer. After discharge, the voltage builds up at a predetermined rate until an internal comparator sampling the inputs from amplifier 38 and time constant network 39, produces an output to cause an internal flip-flop to change state. Therefore, the amplitude of the input from amplifier 38 determines the occurrence of the trailing edge of the rectangular wave output from timer 34. The operation is a constant frequency, variable duty cycle operation.

The input to amplifier 38 is the sum of the voltages at input point 40. In the schematic diagram to be discussed hereinafter it will be seen that there are actually three input connections at this point in the circuit. However, in the block diagram, only two inputs are shown. One input is a control voltage applied through variable "input set" control 42. The other input is applied via "low set" control 44.

Point 40 is a summing point. The circuit ultimately regulates the voltage applied to the lamp load with respect to the control voltages by adjusting circuit operation until there is zero volts at this summing node. In other words, should either a positive or a negative voltage appear at the summing point, the circuit operation regulates itself until this voltage reduces to zero.

For example, assume that there is a positive voltage applied to input set resistor 42, which, following setting by the resistor, results in a voltage level A being applied therefrom to point 40. At the same time, assume that the voltage derived from sensing the voltage across the lamp load applied to point 40 is at a voltage level of −A. The sum of the voltages at point 40 is zero. Hence, the operation of timer 34, as discussed above, remains at an operating condition to produce an output pulse width that produces a lamp load voltage that produces a derived voltage level of −A.

Now assume that the ac line voltage decreases. The lamp load voltages would attempt to decrease by a proportional percentage. The decrease, however, results in a decreased sensed voltage, which has a related voltage-changing effect at the summing node, point 40. A decrease in sensed lamp load voltage results in lowering the threshold at which the timer activates, thereby producing a reduced output pulse width. A reduction in timer pulse width causes the lamp or lamps comprising the lamp load to be "phased on" or turned up until the voltage thereacross matches what it was before the decrease in line voltage occurred. Hence, the circuit again reaches an equilibrium operating condition with zero volts occurring at point 40.

In like manner, a different setting of potentiometer 42 to produce a voltage thereacross at point 40 different from level A, causes amplifier 38 and timer 34 to shift the gating pulses to the thyristors until zero volts again appear at point 40. Depending on the direction of the resetting of resistor 42, the lamps are caused to become either brighter or dimmer. Input set control 42 provides an external voltage between a minimum value and a maximum value so as to provide a means for selecting the desired amount of light intensity from the lamps between predetermined extremes. The circuit operates as a closed loop feedback system.

When there has been no change in the setting of potentiometer 42, but only a change in the line voltage, as in the first example above, the regulation takes place so quickly as to be imperceptible to the eye. In other words, the eye does not detect an operating change in the lamp brightness.

Now turning to the load sensing and curve shaping portion of the circuit, the voltage across the lamp load is sensed by curve shaping network 52. This network includes an initial diode for half-wave rectification, a curve shaping low pass filter, and a variable setting high set resistor 50. The sensed voltage passed by the rectifier is fed into the filter through a first resistor to a storage capacitor and is bled off from the capacitor through a second resistance path including variable high set resistor 50.

The voltage on the capacitor is a dc voltage approximately proportional to the ac voltage across the lamp, but slightly modified by the time constant value of the charge-up path and by the different time constant value of the discharge path. The values of the components are chosen to nonlinearize the output voltage with respect to the input voltage in accordance with the standard IES square law compensation curve, particularly in the low light intensity range.

The function of such curve-shaping components can be best understood by example. It is well known that a measurement of a first light intensity of 4 foot-candles does not appear to the eye to be 4 times as bright as a second light intensity of 1 foot-candle, but instead, appears to be only twice as bright. That is, a light output which varies as the square of the input appears linear to the eye. By selecting the components in curve shaping network 52 in the feedback load sensing loop, IES curve compliance is provided throughout the operating range of the lamps.

The input diode of curve shaping network 52 to which the voltage across the lamp load is applied acts not only as a rectifier, but is important to overall operation of the shaping circuit. Since the diode only conducts on positive-going half-cycles, the capacitor charges on these positive-going half-cycles according to the time constant of the charge-up path. Discharge continues on negative-going half-cycles via the discharge path according to the time constant value thereof. Thus, the network does not actually function as a conventional low pass filter, but actually is a curve shaping process network for the load sense voltage.

High set resistor 50 is a calibration potentiometer for the overall circuit. This calibration potentiometer receives at least some portion of the processed load sensed voltage and provides compensation for differences in circuit parameters prior to applying the voltage to operational amplifier 48. This high set control assures that the proper amount of light emanates from the lamps when the control voltage setting is at its maximum position.

Operational amplifier 48 performs two functions. It inverts the processed load sensed voltage and matches the high impedance of the shaping circuit to the relatively low input impedance of the next stage. The inversion permits operation at summing point 40 in the manner described above. The output of amplifier 48 is applied to the parallel combination of low set resistor 44 and diode 46.

The signal leaving operational amplifier 48 consists of a dc voltage with an ac voltage component; i.e., a ripple voltage determined by the RC time constants in the shaping circuit. At low signal levels, it is desirable to block off part of the dc voltage. It is also desirable to mix part of the dc voltage and the ac ripple voltage. These two functions are accomplished by diode 46 and resistor 44 to accomplish two results. First, "snap-on" is prevented when the lamps are brought from off to dim. Second, the lamps are permitted to go from dim to completely off with a smooth transition. Low set resistor 44 is a calibration potentiometer to permit other circuits operating in conjunction with other lamps to perform in substantially the same manner by compensating for variation in tolerance, age and the like of circuit components.

The available line ac voltage is received in isolation transformer 54, converted to a full wave rectified form in bridge 56 and is filtered in filter 58 to provide suitable +12 volts dc and −12 volts dc for providing the dc bias voltages to the various components.

FIG. 2 shows a simplified block diagram of a Model 555 timer produced by many manufacturers amd useful as timer 34 in the circuit shown in FIGS. 1 and 3.

In operation, a trigger input is applied when the voltage thereto drops below a predetermined level. Normally this level is one-third of the $V_{cc}$ value. When this occurs, internal comparator 82, sampling the trigger input and an internal voltage level of one-third $V_{cc}$ via a voltage divider, causes internal flip-flop 80 to change state so that a high level voltage is applied to the output. Hence, the output of the timer produces a positive-going leading edge of a rectangular wave with the occurrence of a trigger input.

When there is no control voltage applied, then the voltage divider comprising internal resistors 84, 86 and 88 establish one input to another comparator 83 at two-thirds the applied $V_{cc}$ voltage. The threshold input is the other input to comparator 83. Therefore, when the threshold voltage level exceeds two-thirds $V_{cc}$, the flip-flop again changes state to produce a negative-going output or trailing edge of the rectangular wave. The level of the voltage to the internal comparator can be varied from $V_{cc}$ by the application of an external control voltage. The change of state of flip-flop 80 also places a zero level at the discharge output. Hence, the voltage on the discharge output follows the voltage level of the output. That is, these two voltage levels go up and down together.

Now referring to FIG. 3, a schematic diagram of the circuit is shown, like numerals being used to designate components also illustrated in the FIG. 1 block diagram.

The lamp load sense voltage is applied at terminal 110 to diode 112, which provides half wave rectification, prior to application of the voltage to resistor 114. On positive half-cycles of the applied voltage from diode 112, resistor 114 forms a charging path for capacitor 116, the time constant value being determined by these two components. The discharge path for capacitor 116 is through resistor 118 and potentiometer 50 to common. Discharge occurs during the entire period at a time constant determined by components 118, 50 and 116. Therefore, it can be seen that the diode timing enters significantly into non-linearly shaping the output voltage on the wiper of resistor 50, not just the difference in the time constants of the charging and discharging paths. As mentioned above, the components can be selected to provide IES square law curve compensation.

The voltage on the wiper of potentiometer 50 is applied through a resistor to operational amplifier 48. The potentiometer is useful in compensating for differences in circuit parameters from one circuit to the next and for compensating due to component aging and the like. Normally, resistors having 10-percent tolerance are employed throughout the circuit, but a variation of a total of 10 percent is unacceptable. The potentiometer provides control for making the adjustment.

The voltage to operational amplifier 48 is via resistor 120. The processed voltage applied thereto is inverted and applied through resistor 122. Resistor 117 achieves isolation between the control voltage and the line voltage and satisfies Underwriter's Laboratories leakage requirements so that the control voltage is classified as "low voltage". In addition to achieving inversion, operational amplifier 48 also provides matching of the high impedance of the shaping network and the relatively low impedance of diode 46 and resistor 44.

The signal from operational amplifier 48 includes a dc voltage and an ac voltage ripple. As a result of the time constant networks in the shaping circuit at low signal levels, it is desirable to block part of the dc signal and to mix part of the dc signal with the ac ripple voltage. Resistor 44 and diode 46 provide these functions so as to prevent snap-on when bringing the lamp load from off to dim and to allow the lamp to go from dim to completely off with a smooth transition. Potentiometer 44 allows calibration so that all related circuits can be adjusted for substantially uniform performance.

Junction point 40 is the input to operation amplifier 38 and is the summing point for the processed load sensed voltage just described and the other voltages that are applied thereto. One other is the primary control voltage from potentiometer 42. The other connection is via resistor 124 and terminal 126, which can be connected to present a voltage from a current feedback input derived from an auxiliary lamp current sensing circuit. The technique commonly employed in the industry employs a current transformer, a rectifier bridge and a filter to generate a voltage proportional to current, but for present purposes, the voltage applied to terminal 126 can be assumed to be zero.

The control voltage from an external light level control is applied to terminal 128 and common terminal 130. Although there are variations on the scheme of components connectable to these terminals, external controls normally comprise a potentiometer with its ends connected between a dc supply voltage and common. The wiper of the potentiometer normally connects through a diode to terminal 128, the connection permitting paralleling of the potentiometer with other components. The control can be from a source other than a potentiometer, if desired, such as a computer interface.

In any event, the control voltage input is filtered by resistors 132, 134, 136 and capacitor 138. A diode 140 is connected from potentiometer 136 to common to limit deadband at the low end of the control potentiometer and to provide temperature compensation for other components in the circuit. The input set potentiometer allows the circuit to be matched to different controls, such as computer interfaces and control panels made by various manufacturers.

Point 40 is the summing point. The circuit regulates the lamp input voltage with respect to the control input voltage by seeking a sum of zero volts at this so-called "summing node". If an applied voltage thereto, either positive or negative, appears at the summing point, the circuit regulates until zero voltage appears. Operation of the circuit is set forth above with respect to the description of the block diagram.

Capacitors 132 and resistor 134 in parallel around operational amplifier 138 provide filtering of control and line transients, averages the summing point voltage over a period of time and provides damping to prevent oscillation.

Capacitor 136 and resistor 138 determine the external time constant network for establishing the ramp voltage for operation of timer 34. This time constant network is discharged by a reset input preliminary to the application of an input from operational amplifier 38. The width of the output pulse is determined by how long it takes this time constant network to build to a voltage equalling the output from the operational amplifier, and hence activating an internal comparator, as discussed above.

The output of the timer is applied to fast response capacitor 140 from operational amplifier 32, operating as a portion of a pulse generator. Diode 144 acts as a diode clamp. Operational amplifier 32 is connected as an inverter and switches on npn transistor 30 with the occurrence of negative-going voltage transitions from timer 34.

To understand the operation of the pulse generator, consider the connections to pulse transformer 26. Primary 28 of transformer 26 is connected to resistor 146 to a positive bias voltage, the same end of which is connected to capacitor 148. Thus, capacitor 148 is charged. When transistor 30 is switched on, a discharge path for capacitor 148 is provided through primary 28 and transistor 30. This triggers the thyristors respectively connected to secondary windings 22 and 24 via terminals 150 and 152 and 154 and 156, respectively.

Diode 158 in parallel with the primary of the transformer prevents transistor 30 from being damaged when it switches off by providing a path for current to flow when the magnetic field of the transformer collapses.

Isolation transformer 54 receives its input from terminals 158 and 160. The transformer output is rectified by bridge 56 in conventional fashion, and filtered. Zener diodes provide the settings required to produce the +12 volts and −12 volts for providing suitable bias voltage to the various components. An external power supply could alternately provide such low voltage power. Note that near the beginning of each ac cycle, a reset voltage is applied from bridge 56 to timer 34 for discharging the time constant network connected thereto, as previously discussed.

The operational amplifiers throughout the circuit are connected in the preferred embodiment as inverters because operational amplifiers operate more efficiently in such mode. However, they can be operated in non-inverted fashion, if desired. Of course, the control voltage would have to be of compatible polarity at summing point 40.

While a particular embodiment of the invention has been shown and described, it will be understood that the invention is not limited thereto, since modifications may be made and will become apparent to those skilled in the art. For example, the circuit can be calibrated to respond in a quasi-linear manner, rather than in accordance with the IES square law curve, if desired by selection of components and through the calibration adjustments. Also, additional curve shaping can be applied through the control voltage connection. The external connections are suitable for external controls, external calibration, remote sensing or lamp connection and are suitable for computer processing connection.

What is claimed is:

1. An incandescent lamp dimmer connectable to an incandescent lamp, comprising variable voltage means connectable to an ac power source and to said lamp for controlling the light intensity therefrom, said variable voltage means including gate means for turning on the application of ac power for at least a portion of each cycle thereof, and control means for sensing the voltage across the lamp, said control means including curve shaping means for producing a regulated control voltage to said gate means for gating said variable voltage means so as to non-linearly correct for the brightness of the lamp, said control means including reference voltage means for summing to zero with the output from said curve shaping means to provide said regulated control voltage.

2. An incandescent lamp dimmer connectable to an incandescent lamp, comprising at least one thyristor connected to supply current through the lamp from an ac source, a pulse generator connected for gating said thyristor, duty cycle means including a timer producing a rectangular wave pulse output, the pulse width determined by the dc level of the input voltage applied thereto, the trailing edge of said rectangular wave pulse operably connected to said pulse generator, summing means connected to supply a dc voltage to said timer of said duty cycle means, variable control voltage means connected to supply a first dc voltage to said summing means for setting a predetermined level of brightness for the incandescent lamp, and curve shaping means connected to sense at least a proportion of the voltage across the incandescent lamp and producing a second dc voltage to said summing means, said curve shaping means non-linearly correcting for the brightness of the lamp.

3. An incandescent lamp dimmer in accordance with claim 2, wherein said pulse generator includes, a transformer, a secondary of which is connected to the gate of said thyristor, a capacitor connected to the primary of said transformer and a constant voltage source for charging said capacitor, and a semiconductor switch connected to provide a discharge path for said capacitor through the primary of said transformer when the trailing edge of said rectangular wave pulse is received by said pulse generator.

4. An incandescent lamp dimmer in accordance with claim 2, wherein the applied voltages to said summing means are equal to zero at equilibrium operation, a voltage change in one of said first and second dc voltages to said sensing means causing an output voltage change therefrom to said duty cycle means, to change the output width from said duty cycle means, to change the pulse gating of said thyristor, to change the effective voltage across said lamp, thereby causing said second voltage to change to regulate to zero the sum of the voltages applied to said summing means.

5. An incandescent lamp dimmer in accordance with claim 4, and including an inverter connected to one of said variable control voltage means and said curve shaping means so that, in the absence of other voltages applied to the input of said sensing means, the voltages from said variable control voltage means and said curve shaping means are equal and of opposite polarity.

6. An incandescent lamp dimmer in accordance with claim 2, wherein said curve shaping means non-linearly corrects for the brightness of the lamp in accordance with the standard IES square wave law curve.

7. An incandescent lamp dimmer in accordance with claim 5, wherein said curve shaping means includes a first time constant network for charging to a value proportional to the voltage across the lamp, and a second time constant network for discharging from said value, the charging and discharging occurrences providing a processed non-linear voltage portion of said second dc voltage for non-linearly correcting for the brightness of the lamp.

8. An incandescent lamp dimmer in accordance with claim 7, and including a half-wave rectifier connected to receive the sensed voltage, the output therefrom being applied to said first time constant network.

* * * * *

UNITED STATES PATENT AND TRADEMARK OFFICE

CERTIFICATE OF CORRECTION

PATENT NO. : 4,219,761

DATED : August 26, 1980

INVENTOR(S) : Edward H. Mustoe

It is certified that error appears in the above-identified patent and that said Letters Patent are hereby corrected as shown below:

Col. 10, line 29, "claim 5," should be --claim 2,--.

Signed and Sealed this

*Sixth* Day of *January 1981*

[SEAL]

*Attest:*

SIDNEY A. DIAMOND

*Attesting Officer*

*Commissioner of Patents and Trademarks*